US005099989A

United States Patent [19]

Goodin et al.

[11] Patent Number: 5,099,989

[45] Date of Patent: Mar. 31, 1992

[54] GARMENT BAG CLOTHES HANGER MOUNTING APPARATUS

[75] Inventors: John W. Goodin, Coto de Caza; Tim Payne, Santa Ana, both of Calif.

[73] Assignee: French Company, Covina, Calif.

[21] Appl. No.: 655,564

[22] Filed: Feb. 19, 1991

[51] Int. Cl.[5] ..... B65D 85/18

[52] U.S. Cl. ..... 206/286; 206/291; 206/292; 248/316.1; 248/316.5; 248/316.6; 24/516; 24/517

[58] Field of Search ..... 206/278, 279, 284, 286, 206/287, 289, 290, 291, 292, 293; 248/306, 316.1-316.8; 24/515, 516, 517

[56] References Cited

U.S. PATENT DOCUMENTS

| | | | |
|---|---|---|---|
| 3,566,456 | 3/1971 | London | 24/517 |
| 4,363,388 | 12/1982 | London et al. | 206/287 |
| 4,618,058 | 10/1986 | Gregg et al. | 206/287 |
| 4,640,414 | 2/1987 | Mobley et al. | 206/291 |
| 4,732,270 | 3/1988 | Myers et al. | 24/517 |
| 4,753,342 | 6/1988 | Pulichino, Jr. et al. | 206/292 |
| 4,769,878 | 9/1988 | Liao | 206/291 |
| 4,850,562 | 7/1989 | Mazzanti | 206/291 |
| 4,852,845 | 8/1989 | Lewer | 206/291 |
| 4,880,113 | 11/1989 | Mobley | 206/291 |
| 4,986,504 | 1/1991 | Gary | 248/316.1 |
| 4,998,603 | 3/1991 | Nordstrom | 206/292 |
| 5,000,328 | 3/1991 | Hein | 248/316.6 |
| 5,048,785 | 9/1991 | Shaw et al. | 206/291 |

*Primary Examiner*—David T. Fidei
*Attorney, Agent, or Firm*—George J. Netter

[57] ABSTRACT

A clothes hanger (7) mounting apparatus (6) has a housing (12) with a top wall (14), back wall (16) and bottom wall (18) with partial side walls (54, 56) on the upper surfaces of which are secured resilient cushions (66). A cover plate (30) is swingable about the top wall to move a bail (80) with a pair of platens (82, 84) into clamping relationship with the cushions and retain clothes hangers located therebetween.

5 Claims, 5 Drawing Sheets

GARMENT BAG CLOTHES HANGER MOUNTING APPARATUS

BACKGROUND

1. Field of the Invention

The present invention pertains generally to clothes hanger mounting apparatus primarily for use in luggage such as suit packs or garment bags and, more particularly, to such apparatus for lockingly positioning clothes hangers of great variety in a convenient manner within such luggage.

2. Description of Related Art

The well known suit packs or garment bags have posts, trolleys and other similar devices onto which hangers for suits, trousers, skirts, dresses and the like can be positioned in order to hold the clothing items in a neat and orderly arrangement and reduce the possibility of wrinkling or other damage during storage and transportation.

Certain known devices for receiving clothes hangers are specially configured such that only special hangers can be mounted thereon, and other differently constructed hangers either are not capable of being used at all, or, only mounted thereon by deforming the hanger or, result in an awkward and inconvenient arrangement. Other known devices merely accept the hangers in a loose arrangement such that during actual transportation and use the hangers readily slip off allowing the garments to fall in disarray and become wrinkled or damaged with buttons and the like being torn off.

In still other known types of hanger securing devices, the hangers are especially constructed to adapt to a correspondingly designed mounting post which makes it difficult for the clothing items on the hangers to be mounted thereon and to be taken off when it is desired to hang the garments in the closet, for example. This is not only because of obstructions between the different parts of the hanger apparatus but also because of restricted hanger access space being provided which, particularly when the garment bag is relatively full, increases the possibility of dropping the garments or making access to a particular garment that is on the back part of the hanger difficult.

It is, therefore, desirable that hanger receiving and securing apparatus for use in garment bags can accommodate a large variety of hangers having wire bails. Also, it is highly desirable that such hanger receiving apparatus provide ample access over that customarily encountered so that the different hanger styles and configurations can be readily taken on or off with minimum effort and manipulation. Still further, it is desirable that the hangers, once in place on the apparatus, be secured thereon so that the clothing items carried thereby would likewise be secured during use and transportation.

SUMMARY OF THE INVENTION

The described apparatus is especially advantageous for use in a so-called garment bag by mounting to a rigid platelike member frequently forming a part of the garment bag top which provides sufficient strength so that the bag may be hung on a closet hook, for example, by a metal hanging loop secured to the platelike member.

The described apparatus includes a one-piece housing consisting of parallel top and bottom walls, a back wall and an open front. Identical side walls extend upwardly from the bottom wall lateral edges partway to the top leaving a substantial open space on each side between each side wall upper edge and the top wall. A soft rubber cushion is fittingly located over the upper edge of each side wall and between a pair of flanges defining the cushion length.

A front panel is pivotally connected to the housing top wall enabling swinging from a position covering the housing open end to a further position leaving the open end unobstructed for access. A spring detent mounted to the housing bottom wall has parts which lockingly engage a hook extending inwardly from the front panel. Manipulation of the outer end of the spring which extends through a front panel cutout when the panel is closed releases the locking engagement permitting opening of the front panel.

A pressure exerting bail has one end pivotally interconnected to the front panel inward facing surface and its opposite end slidingly received within slots formed in ribs interconnecting the back and top walls. On closing the front panel, the bail moves downwardly and exerts pressure onto the top of the side wall cushions.

In use of the described apparatus, the spring detent is released and the front panel set to the open position. Various hangers, with or without garments, are positioned, from the front or either side, with their respective hooks located on the side wall cushions, the hook ends within the housing preventing them from damaging the bag interior which frequently happens with conventional hanger apparatus that does not protect the hook ends. The front panel is now closed and locked by the spring detent which simultaneously causes the bail to clamp the hanger hooks against the soft rubber cushions. When it is desired to remove one or more hangers from the apparatus, all that is required is to manipulate the spring detent for opening the front panel which, at the same time, releases the bail pressure on the hanger hooks so that they may be removed.

DESCRIPTION OF A PREFERRED EMBODIMENT

Figure 1:
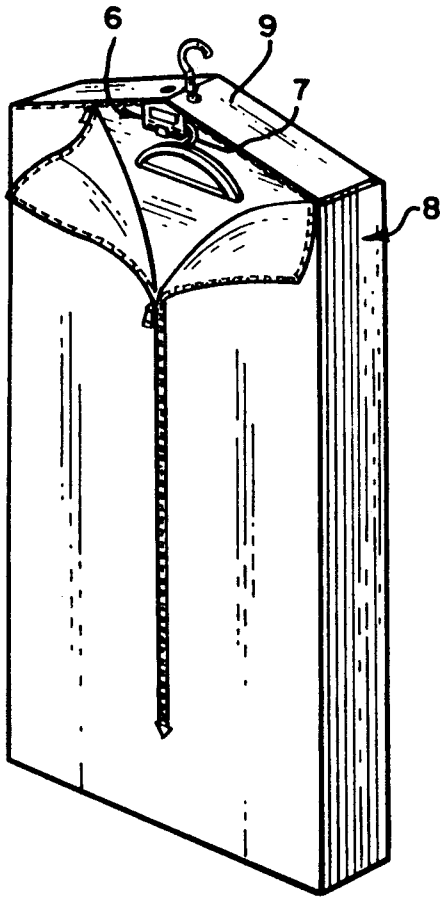
FIG. 1 is a perspective view of a garment bag showing the hanger mounting apparatus of this invention assembled therewith.

With reference now to the drawing and particularly FIG. 1, the hanger mounting apparatus 6 of the present invention is seen to be adapted for securing clothing hanger hooks 7 in place within a garment bag 8, for example. More particularly, preferably the apparatus 6 is affixed to the inner surface of a top panel 9 of the garment bag, and, as will be described, is selectively actuatable to receive a number of clothing hangers hooks 7 of different configurations and lockingly hold the same. After the hangers are in place a front access panel is closed which locks the hanger hooks, and garments carried thereby, in place.

With reference now to the drawing and particularly FIGS. 2 through 8, the hanger apparatus 6 is seen to include a housing 12 having a top wall 14, back wall 16, and bottom wall 18, all integrally related. More specifically, the top wall is substantially parallel to the bottom wall and the back wall intersects the rear edge of the other two walls at about 90 degrees. First and second ribs 20 and 22 extend across the inner corner of the back and top walls and are arranged spaced apart as shown best in FIGS. 7 and 8. The laterally outward facing surface of each rib includes a straight line slot 24 directed at 45 degrees to the back and top walls.

Figure 2:
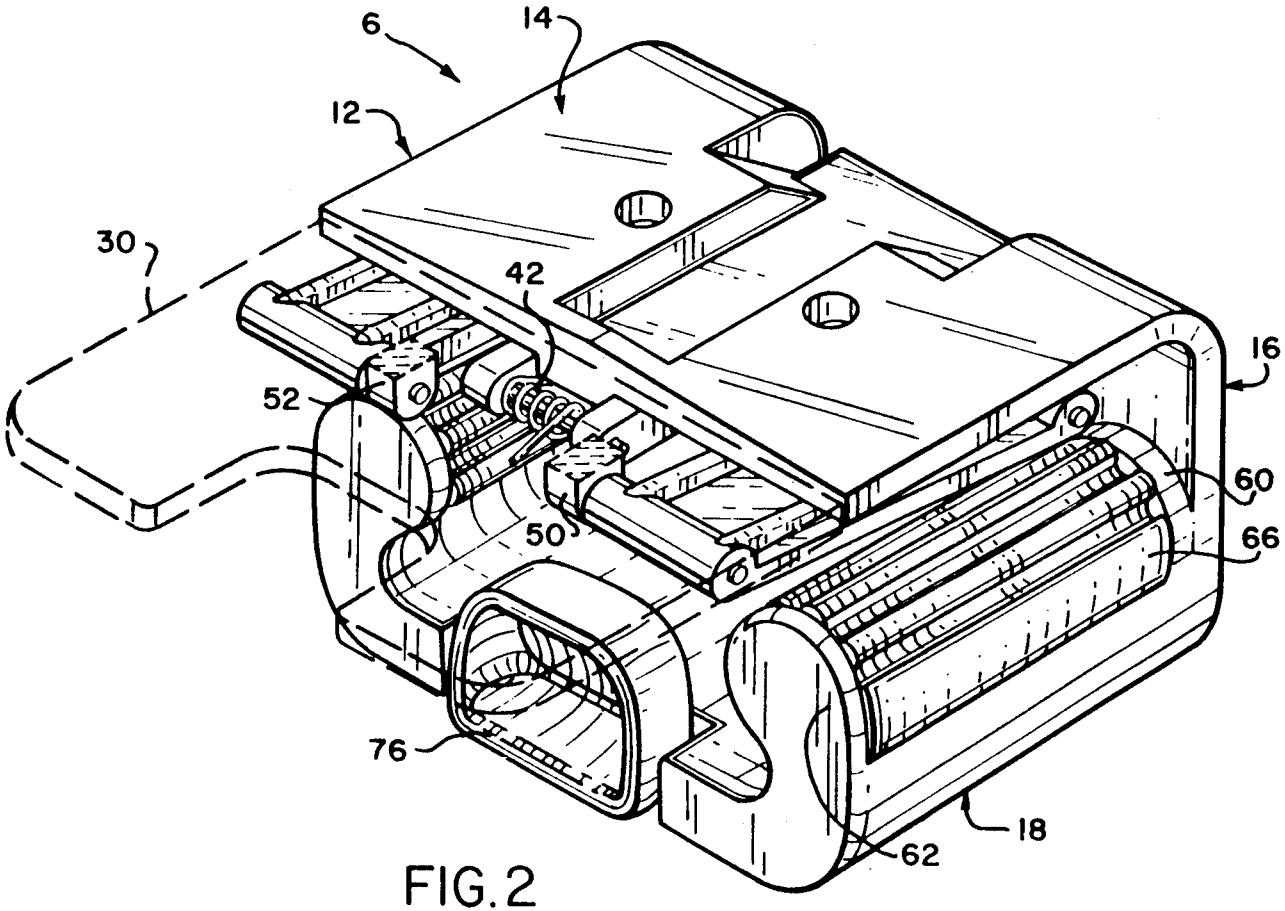
FIG. 2 is a perspective view of the invention shown in the open position.
Figure 3:
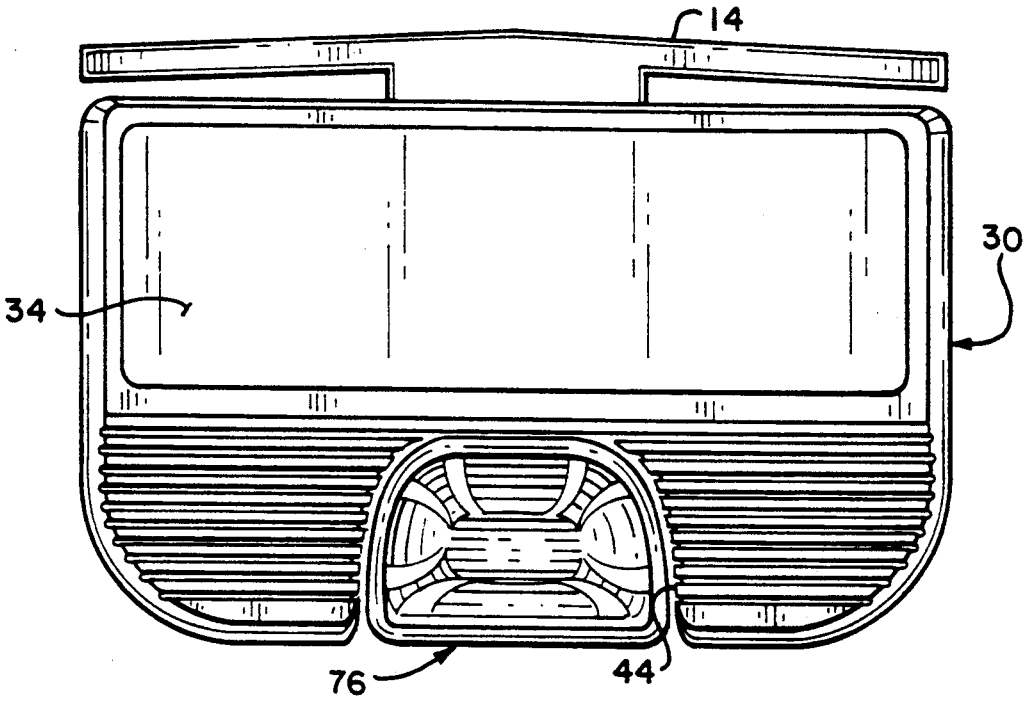
FIG. 3 is a front elevation when in the closed or locked position.
Figure 4:
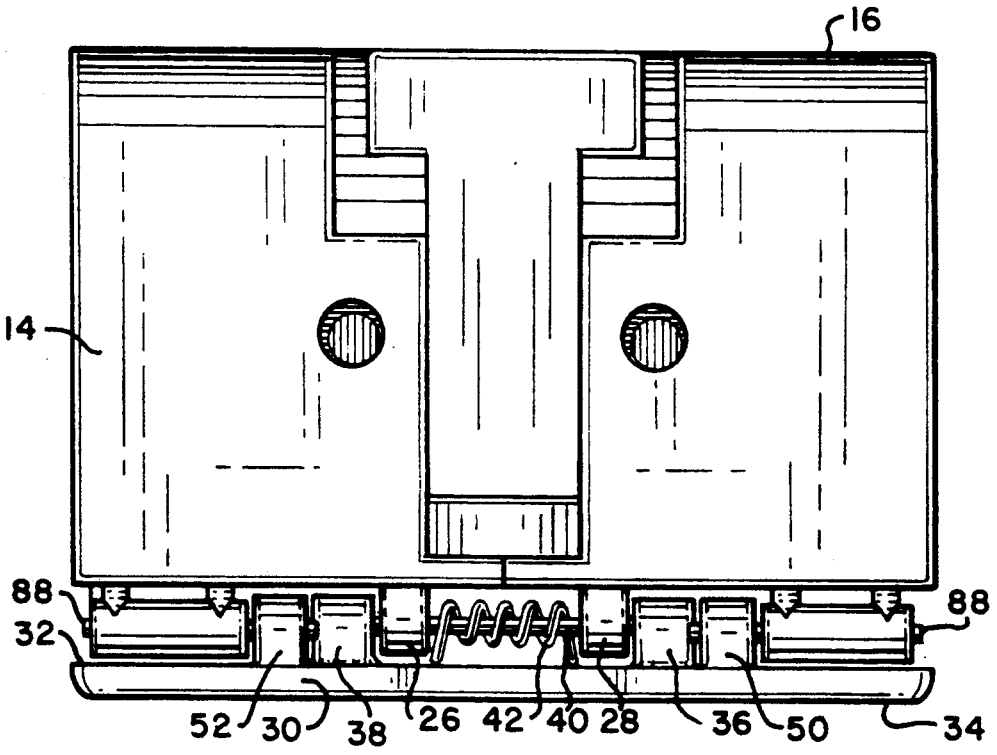
FIG. 4 is a top plan view of the apparatus as it is depicted in FIG. 3.
Figure 5:
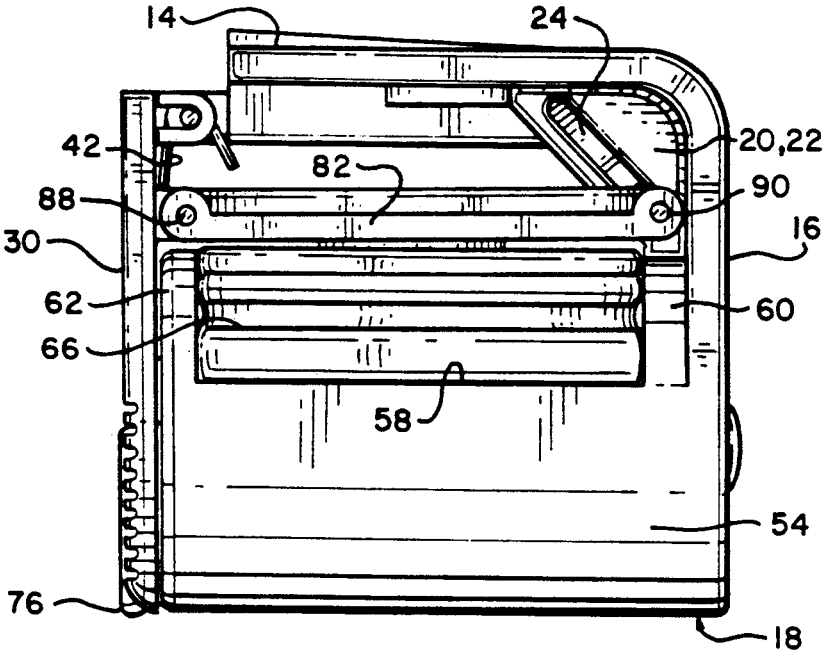
FIG. 5 is a side elevational view of the apparatus of FIG. 3 shown closed.
Figure 6:
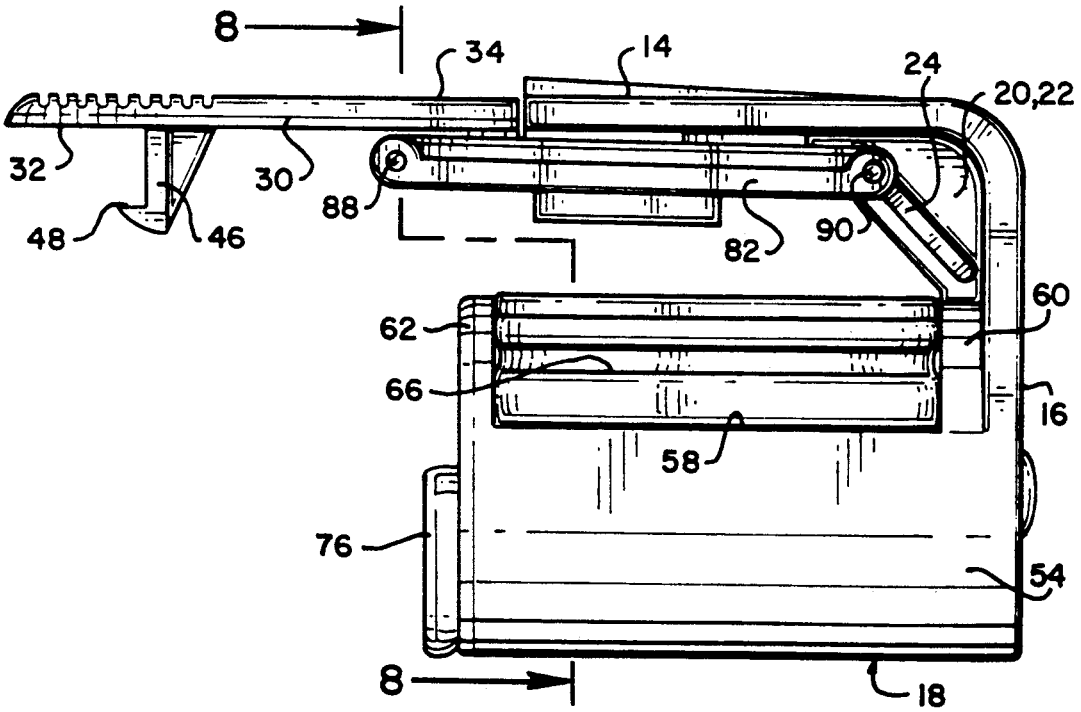
FIG. 6 is a further side elevational view shown open.
Figure 7:
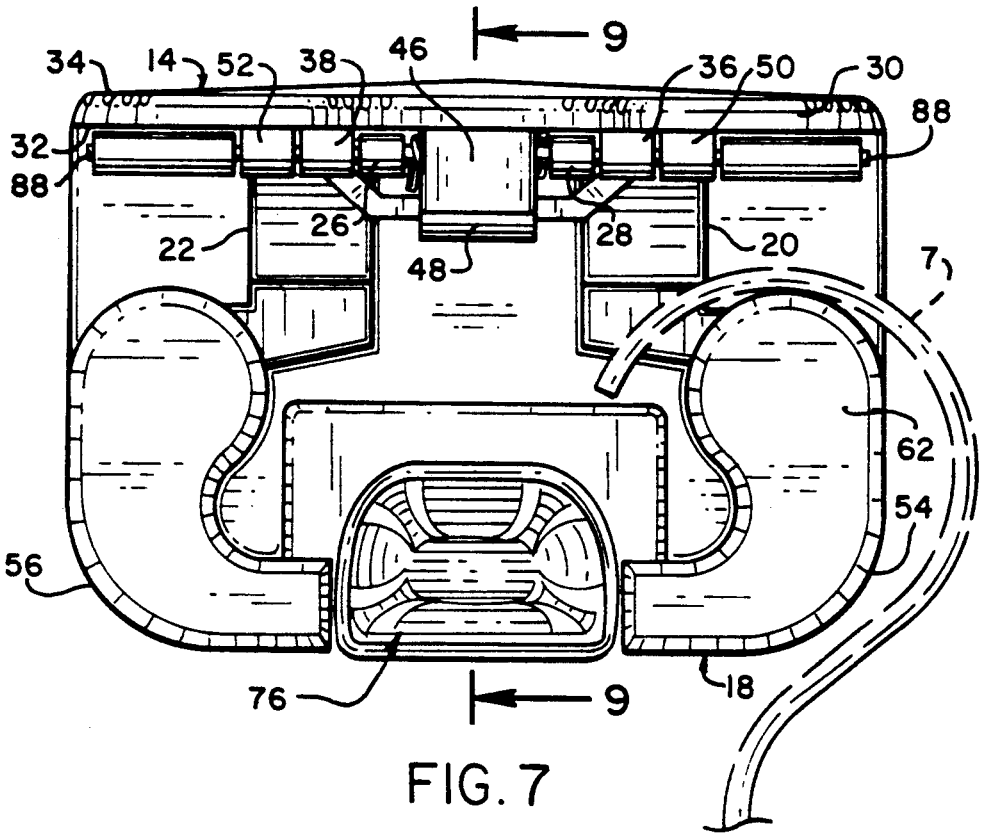
FIG. 7 is a front elevational sectional view taken along line 7—7 of FIG. 6.
Figure 8:
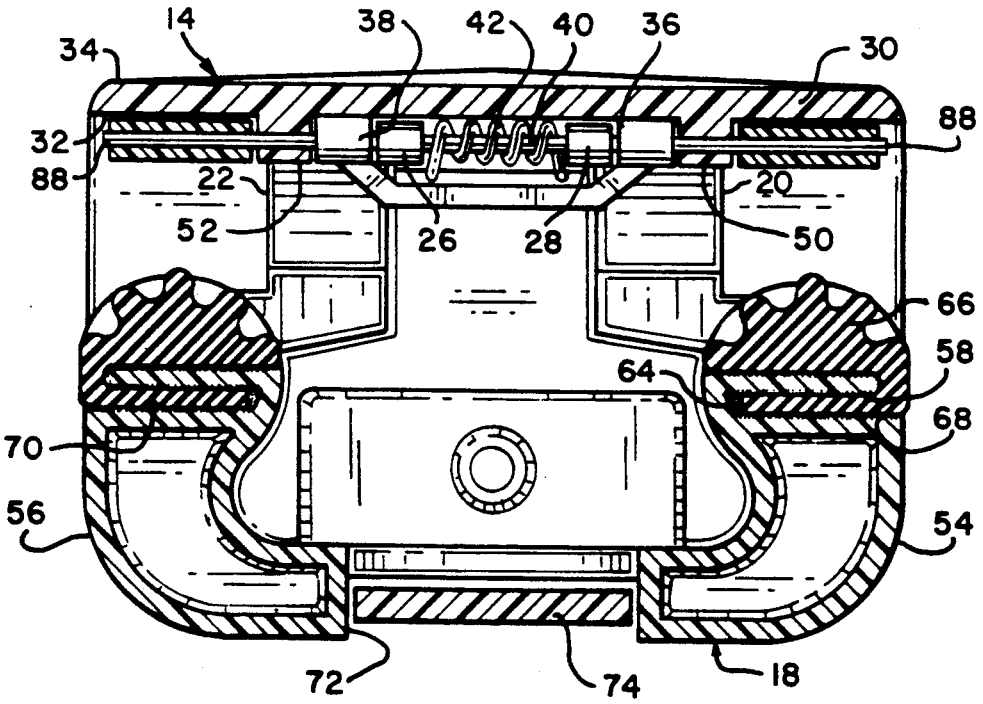
FIG. 8 is a sectional view taken along line 8—8 of FIG. 6.
Figure 9:
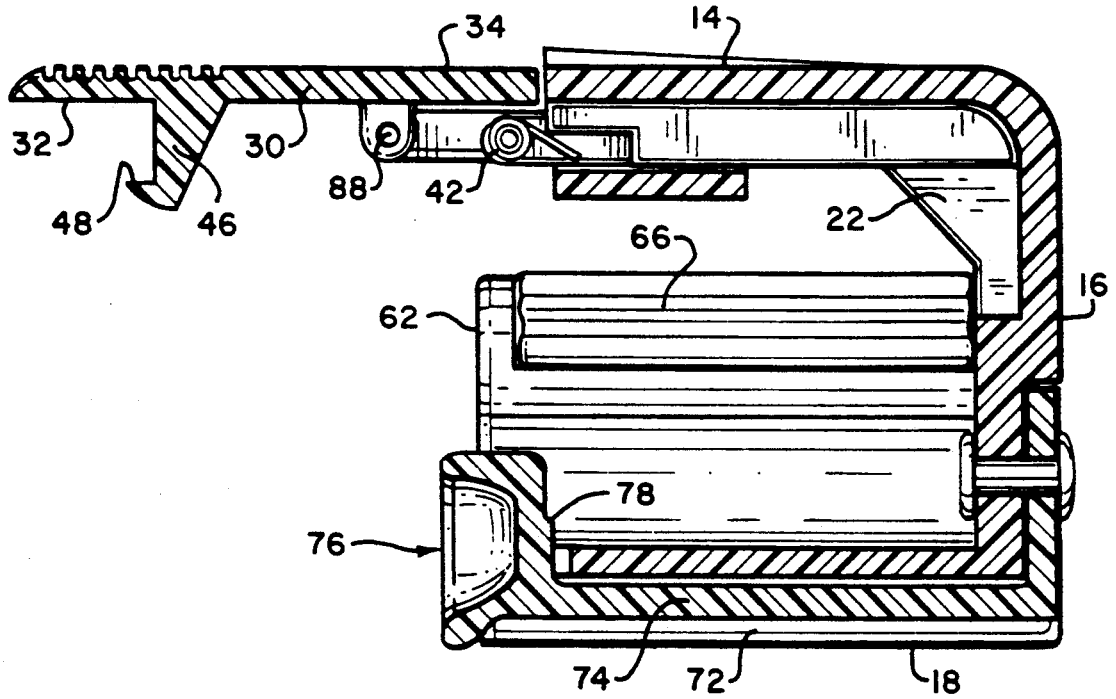
FIG. 9 is a side elevational, sectional view taken along the line 9—9 of FIG. 7.

Turning simultaneously to FIGS. 2, 7 and 8, a pair of spaced apart mounting ears 26 and 28 are unitary with the top wall 14 and extend forwardly of the top wall edge. A cover plate 30 of generally rectangular geometry (FIGS. 5 and 6) has opposite major surfaces 32 and 34 which face inwardly and outwardly, respectively, of the assembled apparatus. More particularly, the inwardly facing surface 32 includes first and second hubs 36 and 38 on the cover plate surface 32 toward the upper edge on assembly and which are spaced apart an amount sufficient to permit a sliding fit about the ends of ears 26 and 28 (FIG. 3). A pin 40 is received through aligned openings in the ears 26, 28 and hubs 36, 38 enabling the cover plate to be selectively pivoted from a closed position on the housing as shown, for example, in FIG. 5 to an open position as in FIG. 6. A coil spring 42 is located on pin 40 between the hubs with the spring end portions contacting the housing top wall 14 and cover plate resiliently urging the cover plate to the open position.

The cover plate also includes a central cutout portion 44 (FIG. 3) extending inwardly from its lower edge. An arm 46 located just above the cutout portion extends from the cover plate inner surface 32 and terminates in a hook 48 to be used for a purpose to be described. Moreover, third and fourth hubs 50 and 52 (FIG. 2) unitary with the cover plate rear surface are located between the arms 46 and the first and second hubs, and lie. respectively, outwardly of the first and second hubs.

The housing bottom wall 18 has both of its side edge portions formed into upwardly extending identical side walls 54 and 56. Specifically, each side wall has a flat upper surface 58 (FIG. 8) with a front to back length defined by a first flange 60 at the back wall and a front flange 62 (FIG. 6). A flat outer surface of the front flange coincides with the bottom wall 18 forward edge. A slot 64 is formed in the outer surface of each side wall just below the side wall flat surface 58.

A soft rubber generally semicylindrical cushion 66 has a flat lower surface 68 for resting receipt on the side wall upper surface 58 at which time its two ends abut against the respective flanges 60 and 62. The cushion also has rim 70 which bends back over the flat surface 68 and is spaced therefrom. The rim is so dimensioned as to fit into the side wall slot 64 when the cushion is assembled onto the side wall flat surface 58 (FIG. 8).

The lower surface of the bottom wall 18 has a relatively broad, centrally located slot 72 running from the front edge to the back wall (FIG. 8). A leaf spring 74 located within the slot 72 has one end secured to the housing at a point adjacent the back wall and its opposite end provided with an actuator 76 (FIGS. 2 and 7). The actuator is dimensioned to enable fitting receipt within the front panel cutout 44 and includes on an inwardly facing surface a body with a shoulder 78 that is lockingly engaged with the hook 48 when the front panel is closed on the housing. Moving the actuator downwardly out of the front panel cutout disengages the front panel hook from the actuator locking shoulder 78 allowing the front panel to snap open under pressure from coil spring 42.

Figure 10:
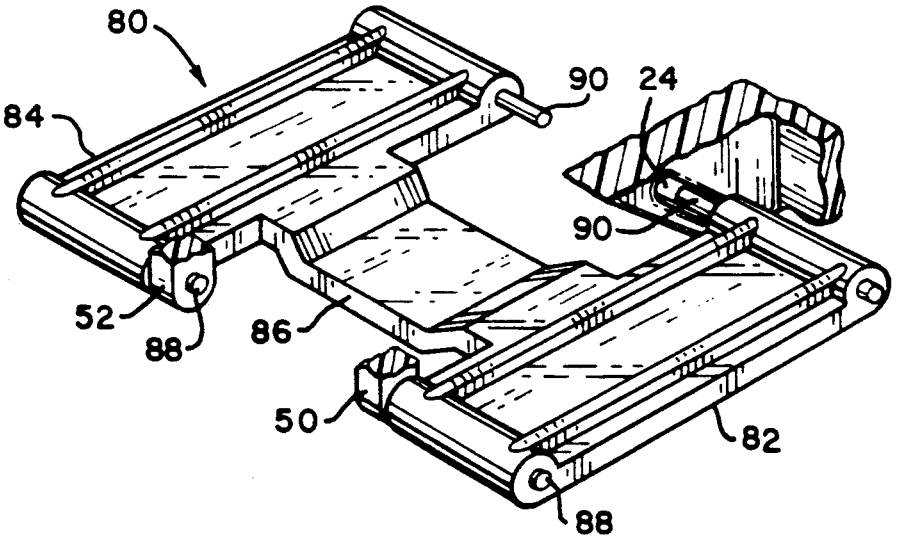
FIG. 10 is a perspective view of a bail.

As best seen in FIG. 10, a bail 80 consists of two generally elongated rectangular platens 82 and 84 held in parallel relation by a cross-arm 86. The dimensioning of the bail and its component parts are such that a first pair of platen end portions can be aligned with the third and fourth hubs 50 and 52 and pivotally secured thereto by pins 88. The remaining pair of platen end portions can be aligned with the third and fourth hubs 50 and 52 and pivotally secured thereto by pins 88. The remaining pair of platen end portions each have a pin 90 that is slidingly received within a respective rib slot 24. With the front panel open, the bail is positioned very close to the top wall 14 and the platens are substantially spaced from the underlying side wall cushions 66. Closing the front panel simultaneously moves the bail downwardly until the platens compress against the upper part of the soft rubber cushions.

The hanger mounting apparatus as assembled and described to this point is then mounted into the garment bag as shown in FIG. 1, namely, secured to a suitably rigid member at the top of the garment bag. If the front panel is in the closed or locked position, the actuator 76 can be moved down releasing the front panel which then automatically opens by action of spring 42. At this time, hangers, with or without clothing on them, may have their respective hooks 7 placed on the side wall cushions (FIG. 7) directly from the front or from the side, whichever is easier. The pressure exerting bail is held out of the way by the raised front panel at this time and does not disturb the loading process. When loading is complete, the front panel is closed and it automatically locks shut securely holding the hanger hooks tightly against the soft rubber cushions. Not only do the cushions 66 prevent damage to the hangers during locking mode, but they also provide a variable clamping range enabling accommodation of a wide variety of different hangers.

As a further beneficial aspect of the invention by virtue of the sliding relation of the inner ends of the bail 80 within the slot 24 in ribs 20, 22, the lower surfaces of the platens are maintained substantially parallel to the upper surfaces of the cushions as the platens engage them which insures retaining a clothes hanger no matter it is located along the cushions.

Although the present invention is described in connection with a preferred embodiment, it is to be understood that one skilled in the appertaining art may be able to make modifications that come within the spirit of the invention and are covered by the appended claims.

What is claimed is:

1. Clothes hanger mounting apparatus for a garment bag, comprising:

a generally U-shaped housing having top and bottom walls with an integrally interconnecting back wall, said top wall being secured to supporting parts in the upper region of the garment bag;

said housing further including first and second sidewalls integral with the housing bottom wall and extending upwardly partway to the top wall;

separate resilient cushion means affixed to the upper surface of each housing side wall;

a cover plate having an edge portion rotatably affixed to the housing top wall edge for movement from a position closing off the U-shaped housing entrance between the top and bottom walls to a further position leaving the entrance unobstructed; and bail means having one end pivotally related to the inner surface of the front cover and an opposite end slidingly received within groove means in rib means interconnected between the housing back and top walls, said bail means moving from a position spaced away from the cushion means when the cover plate is open to a position where first and second platen means compressingly contact the cushion means on the respective first and second sidewalls when the cover plate is closed.

2. Clothes hanger mounting apparatus as in claim 1, in which the housing back and top walls are arranged at substantially 90-degrees to one another, and the groove means in the rib means are disposed at substantially 45-degrees to the housing back and top walls.

3. Clothes hanger mounting apparatus as in claim 1, in which the cushion means include a plurality of grooves extending generally parallel to the side walls.

4. Clothes hanger mounting apparatus as in claim 1, in which the cover plate includes spring means operative between said cover plate and the housing top wall to urge the cover plate into unobstructing relation to the housing entrance, and hook means on an inner surface of the cover plate when said cover plate is closed on the housing; and an actuator spring-mounted onto the housing bottom wall for automatically locking onto the cover plate hook when the cover plate is closed on the housing entrance.

5. Clothes hanger mounting apparatus as in claim 4, in which a leaf spring has an end portion affixed to the housing bottom wall and extending generally parallel to said bottom wall with the actuator secured to an opposite end portion of the leaf spring such that movement of the actuator generally at 90-degrees to the plane of the housing bottom wall releases the hook means from the actuator.

* * * * *